United States Patent [19]

Caruso

[11] Patent Number: 4,510,953

[45] Date of Patent: Apr. 16, 1985

[54] HAIR CURLER

[76] Inventor: Richard Caruso, 7801 Montgomery Ave., Elkins Park, Pa. 19117

[21] Appl. No.: 535,114

[22] Filed: Sep. 23, 1983

[51] Int. Cl.[3] ..... A45D 2/00

[52] U.S. Cl. ..... 132/40; 132/41 R

[58] Field of Search ..... 132/40, 42, 34 R, 36 D, 132/33 O, 38

[56] References Cited

U.S. PATENT DOCUMENTS

| | | | |
|---|---|---|---|
| 1,652,356 | 12/1927 | Hammerly | 132/38 |
| 1,948,467 | 2/1934 | Decker | 132/33 G |
| 2,087,604 | 7/1937 | Mosher | 132/36 D |
| 3,105,503 | 10/1963 | Safianoff | 132/34 R |
| 3,455,309 | 7/1969 | Koss | 132/33 R |
| 3,572,350 | 3/1971 | Adams et al. | 132/39 |
| 3,759,271 | 9/1973 | Caruso | 132/33 G |
| 4,202,360 | 5/1980 | Walter | 132/40 |

*Primary Examiner*—Gregory E. McNeill

*Attorney, Agent, or Firm*—Seidel, Gonda & Goldhammer

[57] ABSTRACT

A hair curler for subjecting hair to steam to effect a curling action includes a hollow perforated core surrounded by a compressible porous foam pad. A generally semicylindrical shield has notches in end walls for receiving the core.

12 Claims, 7 Drawing Figures

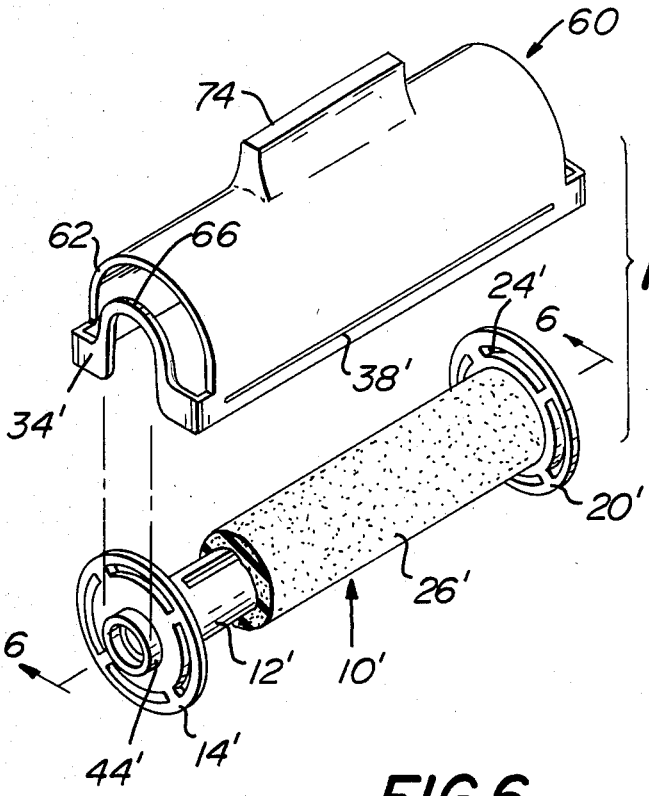
FIG. 4
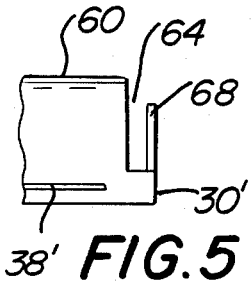
FIG. 5
FIG. 6
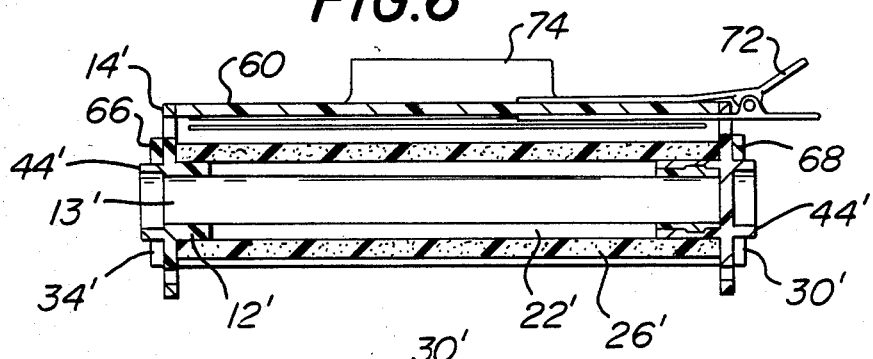
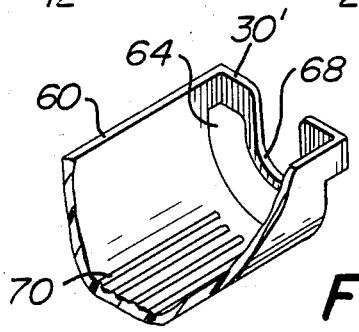
FIG. 7

HAIR CURLER

BACKGROUND OF THE INVENTION

Hair curlers of the general type involved herein are known. See my U.S. Pat. No. 3,759,271 dated Sept. 18, 1973 entitled Hair Curler. The present invention is directed to an improved hair curler which resolves a number of problems associated with the hair curler disclosed in said patent and which are only ascertainable after substantial experience with the use of said hair curler.

While the hair curler disclosed in said patent has been satisfactory, I have found a number of ways to make the hair curler more superior and easier to use. The structural features involved will be described in greater detail hereinafter.

SUMMARY OF THE INVENTION

The present invention is directed to a hair curler adapted for use with steam. The hair curler includes a hollow perforated core. The core has an opening at one end through which steam can be introduced. A porous plastic sleeve surrounds the core. A rim is provided at each end of the core. The diameter of the rim is greater than the diameter of the core. At least one rim is releasably connected to the core. An annular boss is provided on each rim outer surface. Each boss is coaxial with said opening.

The present invention is directed to a hair curler for use with steam which is easier to manufacture and easier to use than the prior art.

Other objects and advantages of the present invention will appear hereinafter.

For the purpose of illustrating the invention, there is shown in the drawings a form which is presently preferred; it being understood, however, that this invention is not limited to the precise arrangements and instrumentalities shown.

FIG. 4 is an exploded view of another hair curler in accordance with the present invention.

FIG. 5 is a partial elevation view of the hair curler shield shown in FIG. 4.

FIG. 6 is a sectional view taken along the line 6—6 in FIG. 4.

FIG. 7 is a partial perspective view of one end of the hair curler shield shown in FIG. 4.

DETAILED DESCRIPTION

Figure 1:
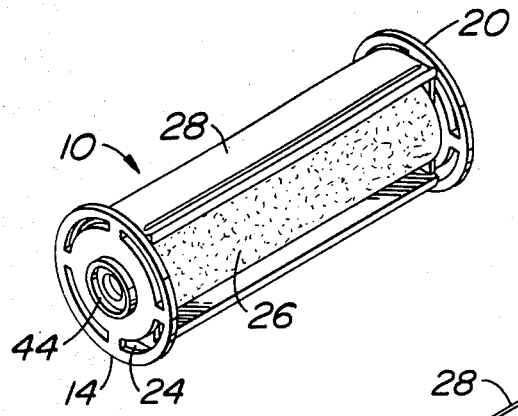
FIG. 1 is a perspective view of a hair curler in accordance with the present invention.
Figure 2:
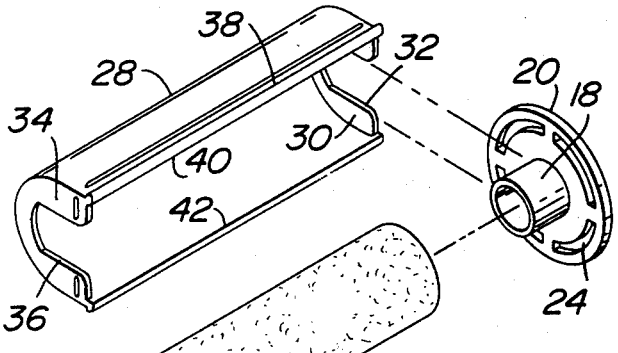
FIG. 2 is an exploded view showing the components of the hair curler.
Figure 3:
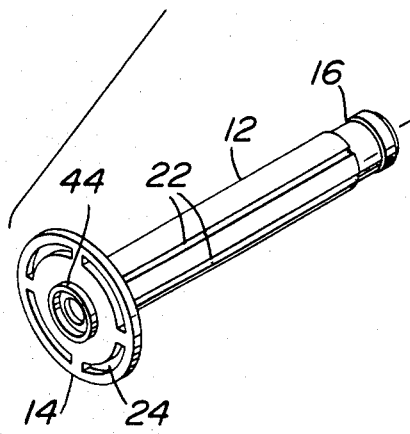
FIG. 3 is a perspective view showing hair being wound around the hair curler.
Figure 3:
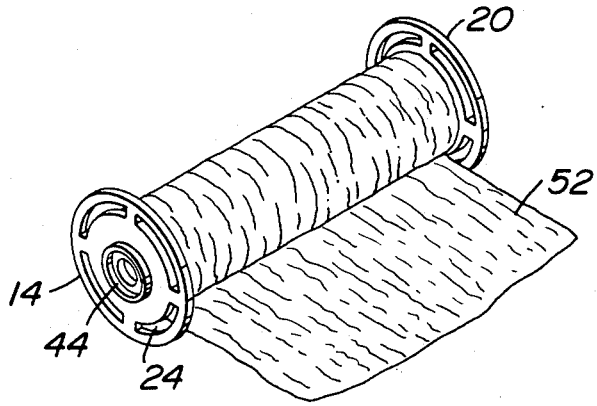

Referring to the drawings in detail, wherein like numerals indicate like elements, there is shown in FIG. 1 a hair curler in accordance with the present invention designated generally as 10. Hair curler 10 includes a core 12 integral at one end with a rim 14. The core 12 is hollow and has an inlet 13 at the end attached to the rim 14. The core 12 has a reduced diameter portion 16 which telescopically receives a hub 18 on rim 20. The rim 20 does not have a hole coaxial with the hub 18. The outer diameter of hub 18 corresponds to the outer diameter of core 12.

The core 12 has a plurality of longitudinally extending slots 22 which terminate at the reduced diameter portion 16. Each of the rims 14, 20 has a plurality of arcuate slots 24. By making core 12 and rim 14 a one piece and hub 18 and rim 20 as a separate piece, manufacture of the roller 10 is simplified. A tubular pad or sleeve 26 surrounds the core 12. Pad 20 is preferably a foam polymeric plastic material so as to be highly porous and compressible. Pad 20 acts as a distributor of steam in all directions with respect to hair to be wound therearound. The tubular pad 26 is telescoped over the core 12 and then hub 18 is snapped onto the reduced diameter portion 16 with a friction fit.

A shield 28 is provided to minimize loss of steam. Shield 28 is generally semi-circular and has end walls 30, 34. A notch 32 is provided in end wall 30. A notch 36 is provided in end wall 34. The transverse dimensions across the notches 32, 36 corresponds generally to the diameter of the core 12 and hub 18. The end walls 30, 34 have a slight interference fit with the inner surfaces of the rims 14, 20.

In order to facilitate rapid separation of the shield 28 from the remainder of the curler 10, there is provided a plurality of ribs or beads 38 adjacent the edge portions 40, 42 on the shield 28. The beads 38 provide a non-slip portion on the otherwise smooth plastic shield.

After a shield is removed and it is desired to unroll the curler from the hair 52, I have found that the easiest and fastest way to do this is to provide the outer surface of the rims 14, 20 with coaxial bosses 44. With a thumb in one boss 44 and a tip of the forefinger in the other boss 44, the fingertips act as an axle for unwinding the curler from the hair 52. Boss 44 on rim 14 performs an added function. A table top electrical steamer has an outlet port. The outer diameter of boss 44 on rim 14 is slightly smaller than the diameter of the outlet. In this manner, the boss 44 fits inside the outlet and acts as a guide to be certain that inlet 13 is in direct communication with the steam within the table top steamer.

The hair curler 10 is preferably provided in sets of different diameters. A set of curlers of a small diameter would be used in connection with short hair, the intermediate diameter curlers would be used with hair of intermediate length, and the largest diameter curlers would be used with long hair to make large curls. The bosses 44 should be coaxial with the longitudinal axis of the core 12 but need not be of the same diameter.

The hair curler 10 is used as follows. The core 12 with the pad 22 therearound is placed on a steamer. After a few seconds, the curler is removed and applied to hair 52 while the shield 28 is placed over the outlet 50 on the steamer. After hair 52 has been wound around the pad 26, a pin or clip may be utilized to anchor the hair 52 to the rims 14, 20. The shield 28 may be positioned so as to embrace the hair 52 that is wound around the pad 26. There is an annular space between the inner surface of shield 28 and the outer surface of pad 26 to accommodate the hair 52.

After a few minutes of being exposed to the steam escaping radially outwardly through slots 22 and pad 26, shield 28 when present is removed by grasping the beads 38. Thereafter, the curler is separated from the hair by putting the thumb in one boss 44 and the tip of the forefinger in the other boss. As pressure is applied in removing the hair curler, the hair curler spins and unwinds itself from the hair.

In FIGS. 4–7, there is illustrated another embodiment of the present invention wherein the hair curler is designated generally as 10'. Hair curler 10' is identical with the hair curler 10 except as will be made clear hereinafter. Corresponding elements are identified by corresponding prime numerals.

The shield 60 is longer than the distance between the end faces of the rims 14', 20'. Adjacent end wall 34', shield 60 has a slot or gap 62 for receiving rim 14'. Adjacent end wall 30', shield 60 has a slot or gap 64 for receiving rim 20'. Each of slots 62, 64 has a width corresponding to the thickness of the rims. End wall 34' includes arcuate bridge 66 juxtaposed to the end face of rim 14. Similarly, end wall 30' has a bridge 68. When assembled as shown in FIG. 6, the rims have a peripheral portion co-extensive with shield 60.

The inner surface of the bight portion of shield 60 may have ridges 70 which help to prevent slippage between the hair 52 and the shield 60. The shield 62 may be held in place on hair 52 by clip 72. Clip 72 has a pair of legs with one leg being insertable through slot 24' on rim 20'. Shield 60 embraces the outer end faces of rim 14', 20 whereby the entire length of pad 26' may be used. Hence, there is no crushing of the ends of the pad 26' by shield 60.

Shield 60 may be provided with a handle 74 extending radially outwardly at the bight as shown in FIG. 4. Handle 74 facilitates handling the shield during that portion of time when steam escapes from the openings at the ends of the shield.

Each embodiment of the present invention has finger contact portions such as those defined by the bosses 44 to facilitate rapid separation of the curler from the hair 52. The boss on rim 20 or 20' need not be annular. In each embodiment of the present invention, there is frictional contact between the end walls of the shields and the adjacent surfaces of the rims as well as frictional contact between an axially extending surface on bosses 44 and the surfaces of the notches in the end walls of the shields. The embodiments of the present invention are structurally interrelated in a manner which facilitates the need for less expensive molds to manufacture the hair curlers and more efficient relationship between the shield and the core and rims for steam retention, and facilitates more rapid removal of the curler from the hair after the hair has been curled.

The present invention may be embodied in other specific forms without departing from the spirit or essential attributes thereof and, accordingly, reference should be made to the appended claims, rather than to the foregoing specification, as indicating the scope of the invention.

I claim:

1. A hair curler for use with steam comprising a hollow perforated core, said core having an opening only at one end, a porous sleeve around said core, a rim at each end of the core, the diameter of the rim being greater than the diameter of the core, a shield which is generally semi-circular, said shield having end walls, said shield having a slot at each end, each slot receiving one of said rims so that the core is between said end walls.

2. A hair curler in accordance with claim 1 including a finger contact surface on the exterior end surface of each rim, at least one of said finger contact surfaces being annular and coaxial with said opening.

3. A hair curler in accordance with claim 2 wherein the outer peripheral surface of one finger contact surface engages the surfaces of a notch in one end wall of the shield.

4. A hair curler in accordance with claim 1 wherein each rim has an axially extending aperture exposed at its associated slot for receiving a clip.

5. A hair curler in accordance with claim 1 including at least one ridge on the outer peripheral surface of the shield adjacent the free ends thereof to increase friction and facilitate rapid grasping of the shield.

6. A hair curler in accordance with claim 2 wherein each of said finger contact surfaces is an annular boss extending in opposite directions away from their associated rims and having a diameter corresponding generally to the diameter of the core.

7. A hair curler for use with steam comprising a hollow core having longitudinally extending slots, an opening at only one end of the core, a porous sleeve around said core, a rim at each end of the core, a shield, each end of said shield having a slot, each slot receiving one of said rims, a finger contact portion on the outer surface of each rim and extending away from the adjacent end of said core, one of said finger contact portions being annular on its inner surface and coaxial with said opening.

8. A hair curler in accordance with claim 7 including a handle projecting outwardly from the periphery of said shield.

9. A hair curler for use with steam comprising a hollow perforated core, said core having an opening only at one end, a porous foam plastic tubular pad around said core, a rim at each end of the core, the diameter of the rims being greater than the diameter of the core, a finger contact surface on the exterior surface of each rim, each of said finger contact surfaces being coaxial with said opening, a removable shield which is generally semi-circular, said shield having end walls, a slot at each end of the shield, each slot being defined on one side by a portion of an end wall, said end walls being juxtaposed to an associated rim while the rims are received in said slots.

10. A hair curler in accordance with claim 9 wherein said rims have axially extending passageways at least one of which is exposed at said slots.

11. A hair curler in accordance with claim 9 wherein each end wall has spaced portions connected by an arcuate bridge.

12. A hair curler in accordance with claim 9 wherein a handle projects radially outwardly at the bight portion of said shield.

* * * * *